US009102041B2

(12) United States Patent
Chen

(10) Patent No.: US 9,102,041 B2
(45) Date of Patent: Aug. 11, 2015

(54) COMBINATIONAL TOOL HOLDER DEVICE

(71) Applicant: A-Tina Tools Co., Ltd., Taichung (TW)

(72) Inventor: Kun-Chen Chen, Taichung (TW)

(73) Assignee: A-Tina Tools Co., Ltd., Taichung (TW)

( * ) Notice: Subject to any disclaimer, the term of this patent is extended or adjusted under 35 U.S.C. 154(b) by 59 days.

(21) Appl. No.: 14/098,972

(22) Filed: Dec. 6, 2013

(65) Prior Publication Data

US 2015/0158154 A1 Jun. 11, 2015

(51) Int. Cl.
*B25B 23/16* (2006.01)
*B25B 13/56* (2006.01)

(52) U.S. Cl.
CPC ..... *B25B 13/56* (2013.01)

(58) Field of Classification Search
USPC ..... 206/372, 375, 376, 377; 81/436, 439, 81/440, 177.4, 490
See application file for complete search history.

(56) References Cited

U.S. PATENT DOCUMENTS

| | | | | |
|---|---|---|---|---|
| 2,786,380 | A * | 3/1957 | Rolland | 81/440 |
| 6,032,796 | A * | 3/2000 | Hopper et al. | 206/377 |
| 7,380,660 | B2 * | 6/2008 | Lin | 206/375 |
| 2006/0101955 | A1 * | 5/2006 | Chang | 81/490 |
| 2008/0202963 | A1 * | 8/2008 | Liao | 206/377 |
| 2009/0266731 | A1 * | 10/2009 | Johnson et al. | 206/375 |

* cited by examiner

*Primary Examiner* — Jacob K Ackun
(74) *Attorney, Agent, or Firm* — C. G. Mersereau; Nikolai & Mersereau, P.A.

(57) ABSTRACT

A combinational tool holder device has a holder base, a first combination holder and a second combination holder. An inner tube of the holder base has multiple longitudinal insertion holes longitudinally formed in the inner tube and multiple radial insertion troughs radially formed in the inner tube and respectively communicating with the longitudinal insertion holes. The first combination holder and the second combination holder are mounted around the holder base and both have tool insertion holes. The first combination holder clamps the holder base by two first holder claws, and the second combination holder clamps the holder base by two second holder claws. A first interval between the two second holder claws is larger than a second interval between the two first holder claws.

15 Claims, 10 Drawing Sheets

COMBINATIONAL TOOL HOLDER DEVICE

BACKGROUND OF THE INVENTION

1. Field of the Invention

The present invention relates to a tool holder, and more particularly to a combinational tool holder device.

2. Description of Related Art

A tool holder is applied for holding multiple hexagon wrenches, such that the hexagon wrenches can be carried for use easily. A conventional tool holder has multiple hexagonal holes formed through the tool holder. Multiple hexagon wrenches are respectively inserted in the hexagonal holes and are fixed relative to the tool holder.

In use, one of the hexagon wrenches is taken from the corresponding hexagonal hole. Then, the hexagon wrench is inserted in an adapter tube to be used since the radial size of the hexagon wrench is not suitable for direct use by hand.

However, the adapter tube and the tool holder are separate elements with individual designs, and the adapter tube cannot be attached to and held on the tool holder. Therefore, it is inconvenient for a user to carry the adapter tube and the tool holder at the same time.

SUMMARY OF THE INVENTION

The main objective of the present invention is to provide a combinational tool holder device to resolve the aforementioned problems.

The combinational tool holder device has a holder base, a first combination holder, and a second combination holder.

The holder base has an inner tube. The inner tube has multiple longitudinal insertion holes and multiple radial insertion troughs. The longitudinal insertion holes are hexagonal in cross section, are longitudinally formed in the inner tube at intervals, and are selectively formed through the inner tube. The radial insertion troughs are radially formed in the inner tube at intervals and respectively communicate with the longitudinal insertion holes.

The first combination holder is detachably mounted around the holder base and has a first holder body and two first holder claws. The first holder body has multiple tool insertion holes that are hexagonal in cross section and are formed through the first holder body at intervals, wherein each tool insertion hole of the first holder body has a longitudinal direction that is parallel with a longitudinal direction of the inner tube. The first holder claws are radially elastic, are connected with the first holder body, and are detachably mounted around the holder base.

The second combination holder is detachably mounted around the holder base and has a second holder body and two second holder claws. The second holder body has multiple tool insertion holes that are hexagonal in cross section and are formed through the second holder body at intervals, wherein each tool insertion hole of the second holder body has a longitudinal direction that is parallel with the longitudinal direction of the inner tube. The second holder claws are radially elastic, are connected with the first holder body, and are detachably mounted around the holder base, wherein a first interval between the two second holder claws is larger than a second interval between the two first holder claws.

Other objectives, advantages and novel features of the present invention will become more apparent from the following detailed description when taken in conjunction with the accompanying drawings.

DETAILED DESCRIPTION OF PREFERRED EMBODIMENT

Figure 1:
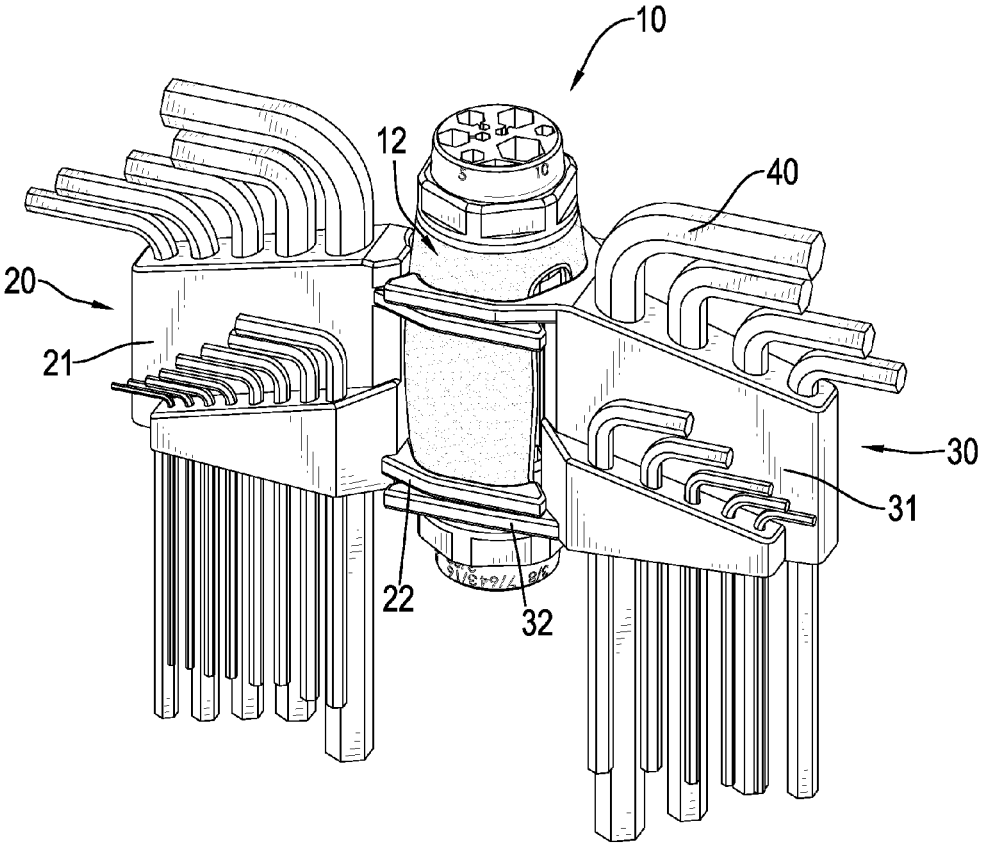
FIG. 1 is a perspective view of a first preferred embodiment of a combinational tool holder device in accordance with the present invention.
Figure 2:
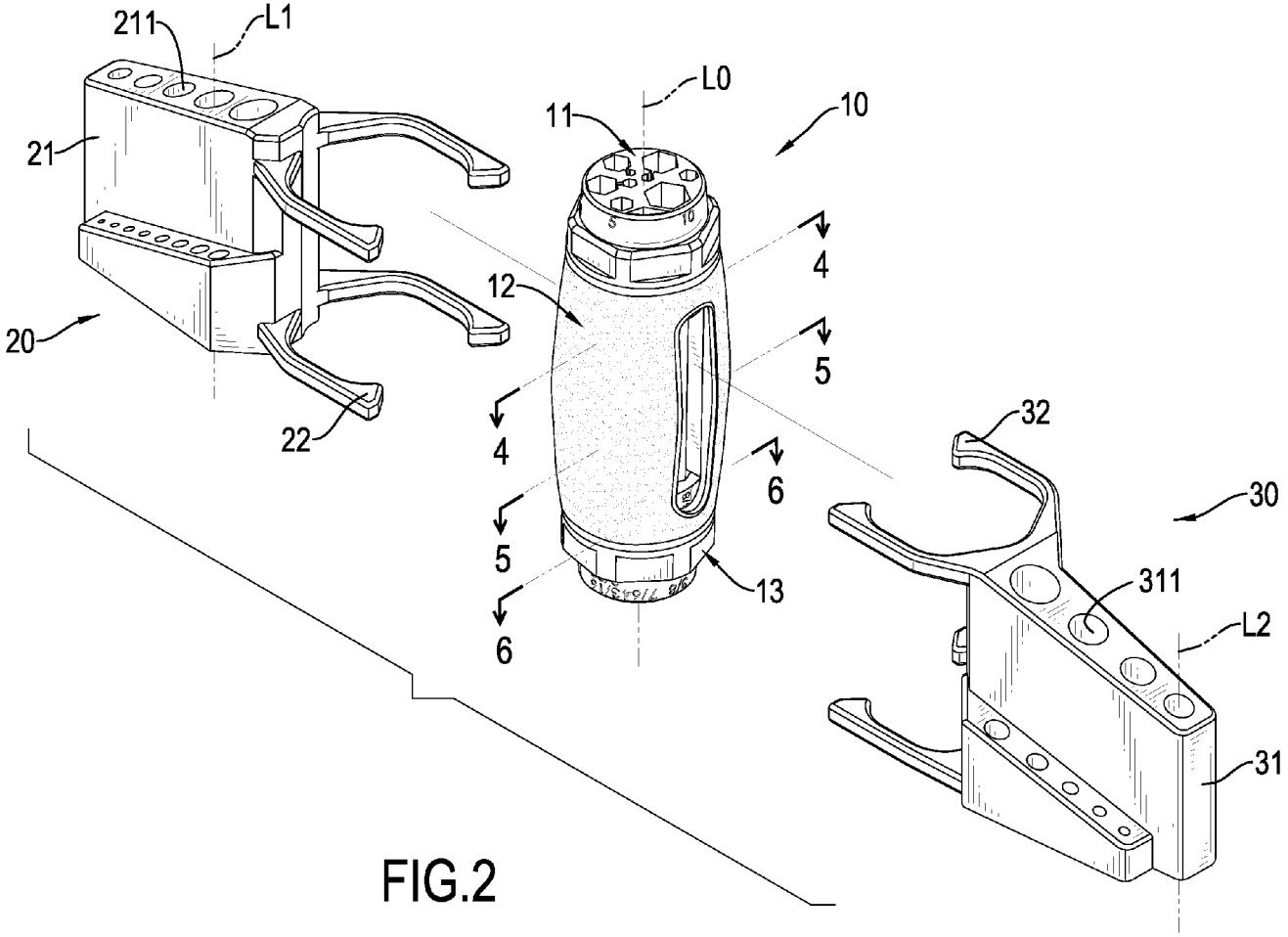
FIG. 2 is an exploded perspective view of the combinational tool holder device in FIG. 1.
Figure 3:
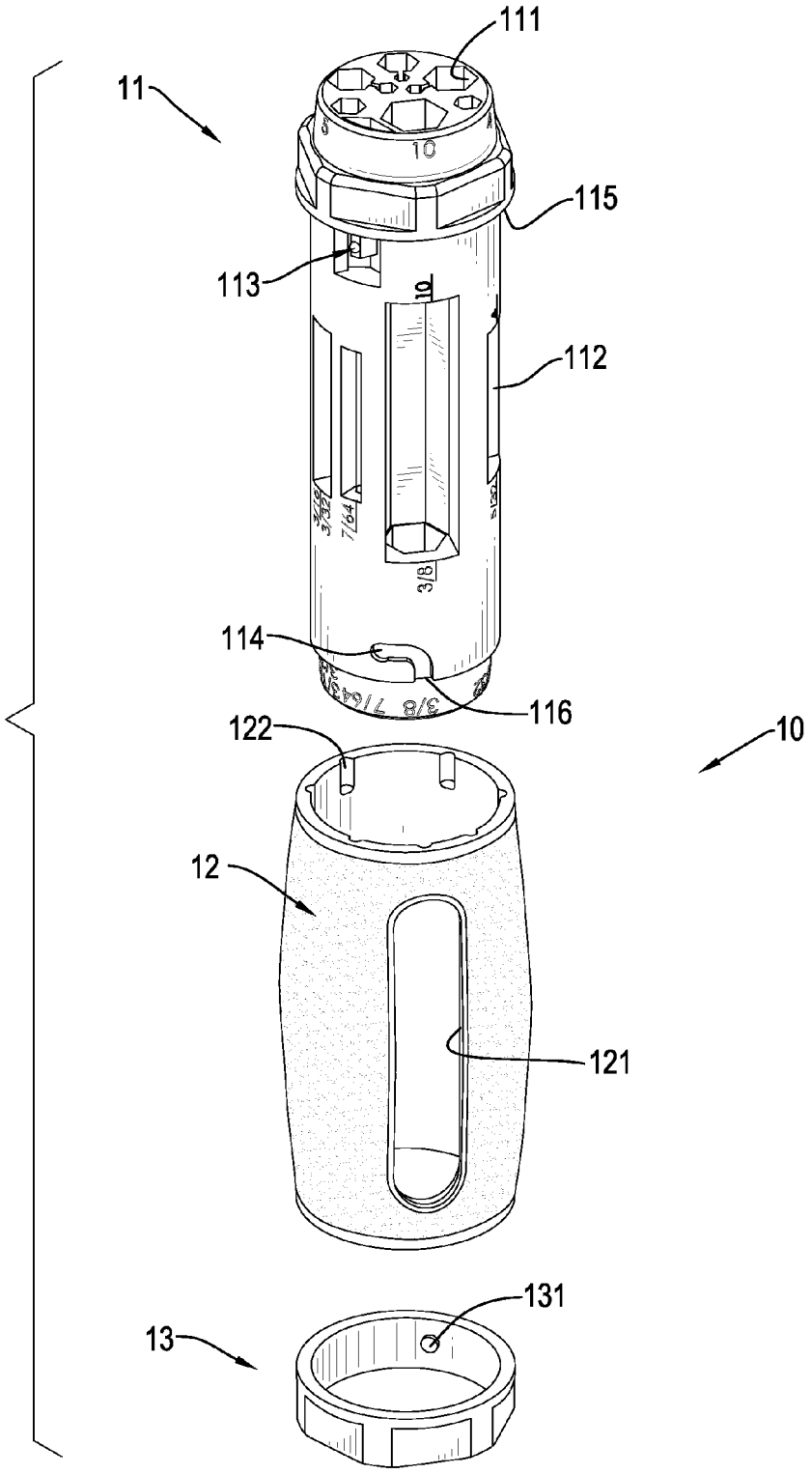
FIG. 3 is a partially exploded perspective view of a holder base of the combinational tool holder device in FIG. 1.
Figure 4:
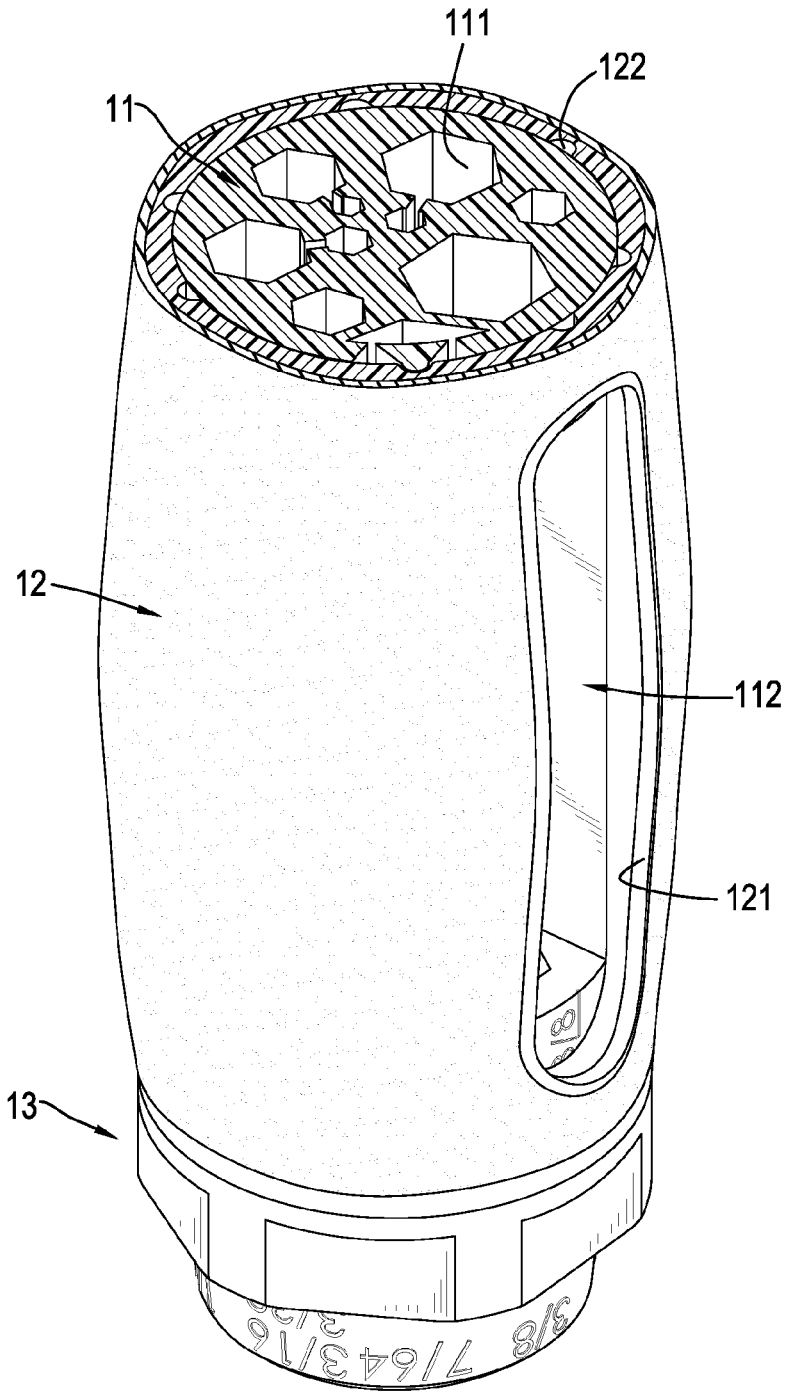
FIG. 4 is a cross sectional perspective view of the holder base of the combinational tool holder device along line 4-4 in FIG. 2.
Figure 5:
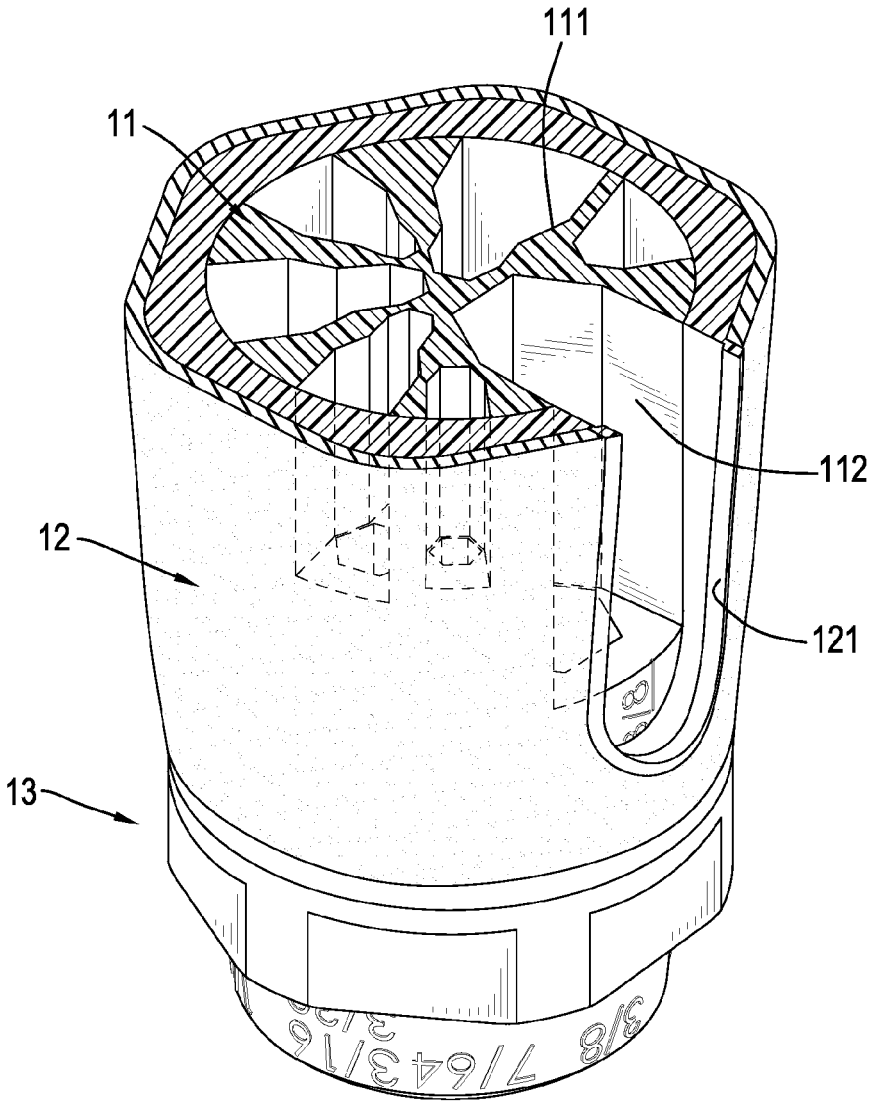
FIG. 5 is a cross sectional perspective view of the holder base along line 5-5 in FIG. 2.
Figure 6:
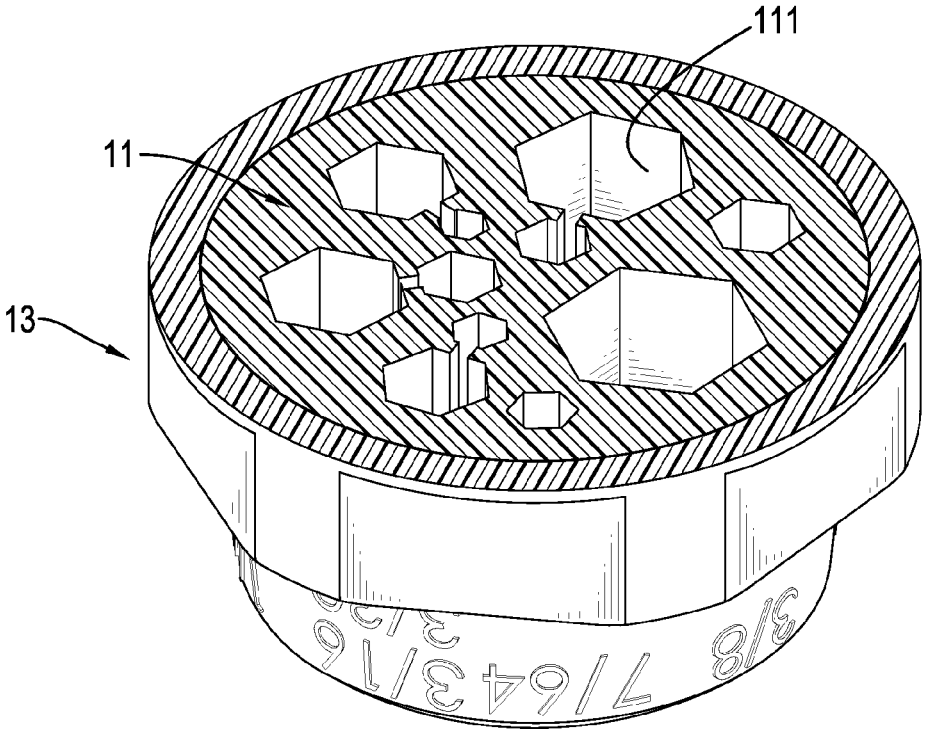
FIG. 6 is a cross sectional perspective view of the holder base along line 6-6 in FIG. 2.

With reference to FIGS. 1 to 3, a first preferred embodiment of a combinational tool holder device in accordance with the present invention has a holder base 10, a first combination holder 20, and a second combination holder 30.

With reference to FIGS. 3 to 6, the holder base 10 is cylindrical and has an inner tube 11, an outer tube 12 and a fixing ring 13. The inner tube 11 has multiple longitudinal insertion holes 111, multiple radial insertion troughs 112, an outer tube fixing portion 113, two fixing ring fixing portions 114, and an abutting rib 115. The longitudinal insertion holes 111 are hexagonal in cross section, are longitudinally formed in the inner tube 11 at intervals, and are selectively formed through the inner tube 11. The longitudinal insertion holes 111 have different cross sectional sizes from each other. The radial insertion troughs 112 are radially formed in the inner tube 11 at intervals and respectively communicate with the longitudinal insertion holes 111. The longitudinal insertion holes 111 have different cross sectional sizes from each other. The outer tube fixing portion 113 protrudes from the inner tube 11. The fixing ring fixing portions 114 are L-shaped, are recessed in the inner tube 11 diametrically opposite each other at two ends of a diameter of the inner tube 11, and are adjacent to an end of the inner tube 11. Each fixing ring fixing portion 114 has an opening 116 that is formed at an end of the fixing ring fixing portion 114, wherein a normal direction of the opening 116 is parallel with a longitudinal direction of the inner tube 11. The abutting rib 115 annularly protrudes from the inner tube 11 and is adjacent to another end of the inner tube 11 opposite to the fixing ring fixing portions 114.

The outer tube 12 is hollow and is rotatably mounted around the inner tube 11. An end of the outer tube 12 abuts the abutting rib 115. The outer tube 12 has an alignment hole 121 and multiple engaging portions 122. The alignment hole 121 is formed through the outer tube 12 and is selectively aligned with one of the radial insertion troughs 112. The engaging portions 122 are recessed in an interior surface of outer tube 12 at intervals. One of the engaging portions 122 is engaged with the outer tube fixing portion 113 to form a concave-convex engagement. Alternatively, the engaging portions 122 may protrude from the interior surface of the outer tube 12 and the outer tube fixing portion 113 may be recessed in the inner tube 11.

The fixing ring 13 is hollow, is mounted around the end of the inner tube 11 opposite to the abutting rib 115, and has two engaging points 131. The engaging points 131 protrude from an interior surface of the fixing ring 13 diametrically opposite each other at two ends of an inner diameter of the fixing ring 13, and are respectively engaged with the fixing ring fixing portions 114. With reference to FIGS. 1 and 2, the first combination holder 20 is detachably mounted around the holder base 10 and has a first holder body 21 and two first holder claws 22. The first holder body 21 has thirteen tool insertion holes 211. The tool insertion holes 211 of the first holder body 21 are hexagonal in cross section and are formed through the first holder body 21 at intervals. The tool insertion holes 211 of the first holder body 21 have different cross sectional sizes from each other. A longitudinal direction L1 of each tool insertion hole 211 of the first holder body 21 is parallel with the longitudinal direction L0 of the inner tube 11. The first holder claws 22 are C-shaped and radially elastic, are connected with the first holder body 21, and are detachably mounted around the holder base 10.

The second combination holder 30 is detachably mounted around the holder base 10 and has a second holder body 31 and two second holder claws 32. The second holder body 31 has nine tool insertion holes 311. The tool insertion holes 311 of the second holder body 31 are hexagonal in cross section and are formed through the second holder body 31 at intervals. The tool insertion holes 311 of the second holder body 31 have different cross sectional sizes from each other. A longitudinal direction L2 of each tool insertion hole 311 of the second holder body 31 is parallel with the longitudinal direction L0 of the inner tube 11. The second holder claws 32 are C-shaped and radially elastic, are connected with the second holder body 31, and are detachably mounted around the holder base 10. A first interval between the two second holder claws 32 is larger than a second interval between the two first holder claws 22.

In assembling, multiple hexagon wrenches 40 that have different radial dimensions from each other are respectively inserted in the size-fitted tool insertion holes 211, 311. The first combination holder 20 and the second combination holder 30 are mounted around the holder base 10 by the first holder claws 22 and the second holder claws 32 respectively. The first holder claws 22 and the second holder claws 32 are deformed radially and elastically to clamp the holder base 10 since the first holder claws 22 and the second holder claws 32 are radially elastic.

Figure 7:
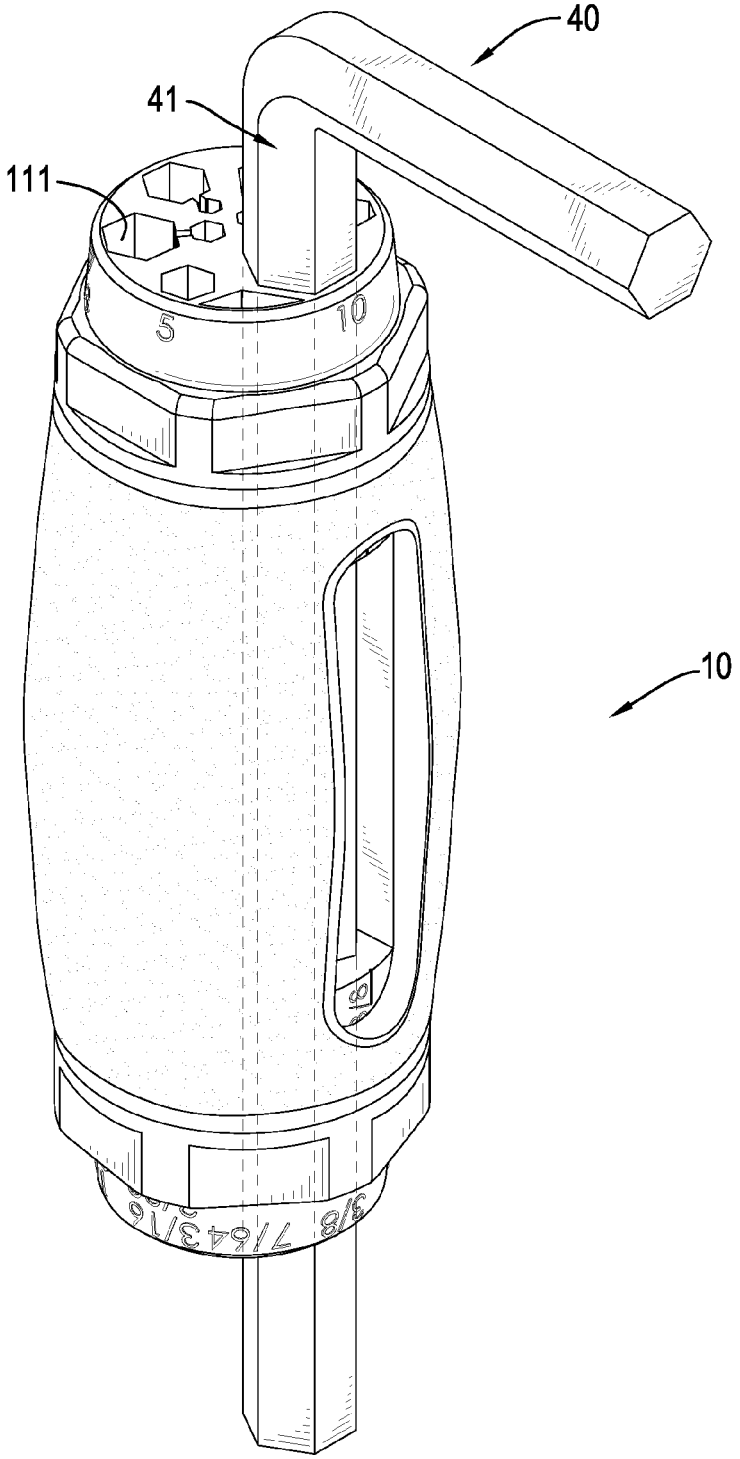
FIG. 7 is an operational perspective view of the holder base of the combinational tool holder device in FIG. 1.
Figure 8:
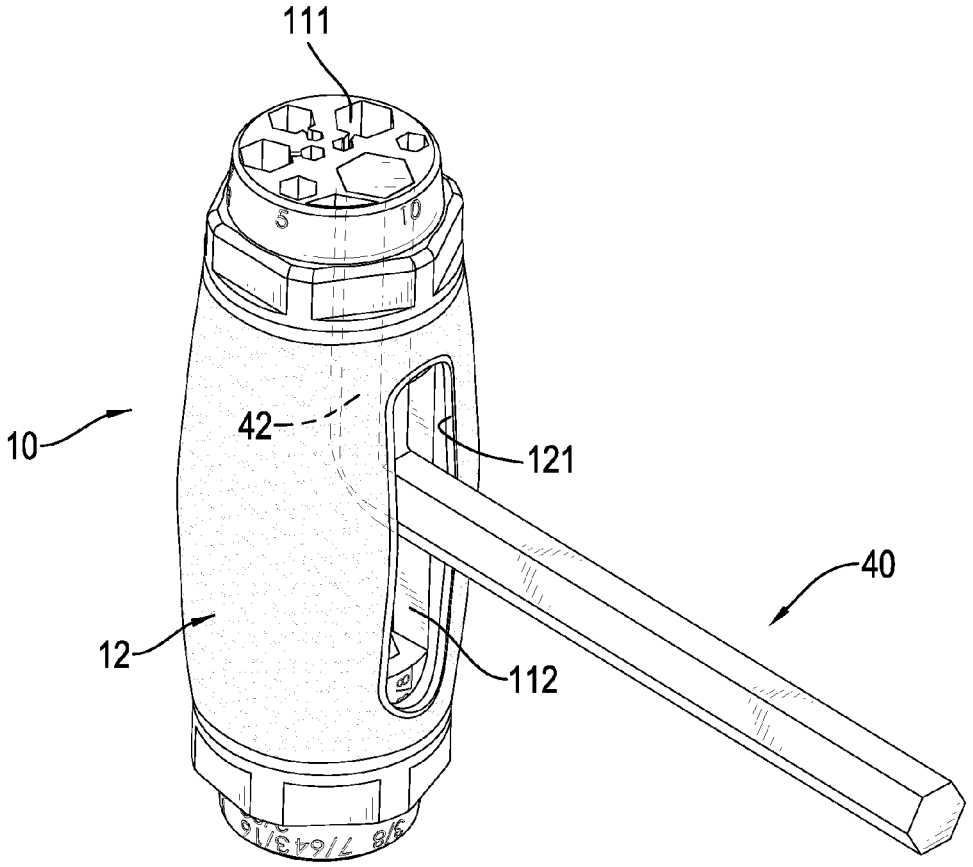
FIG. 8 is another operational perspective view of the holder base of the combinational tool holder device in FIG. 1.
Figure 9:
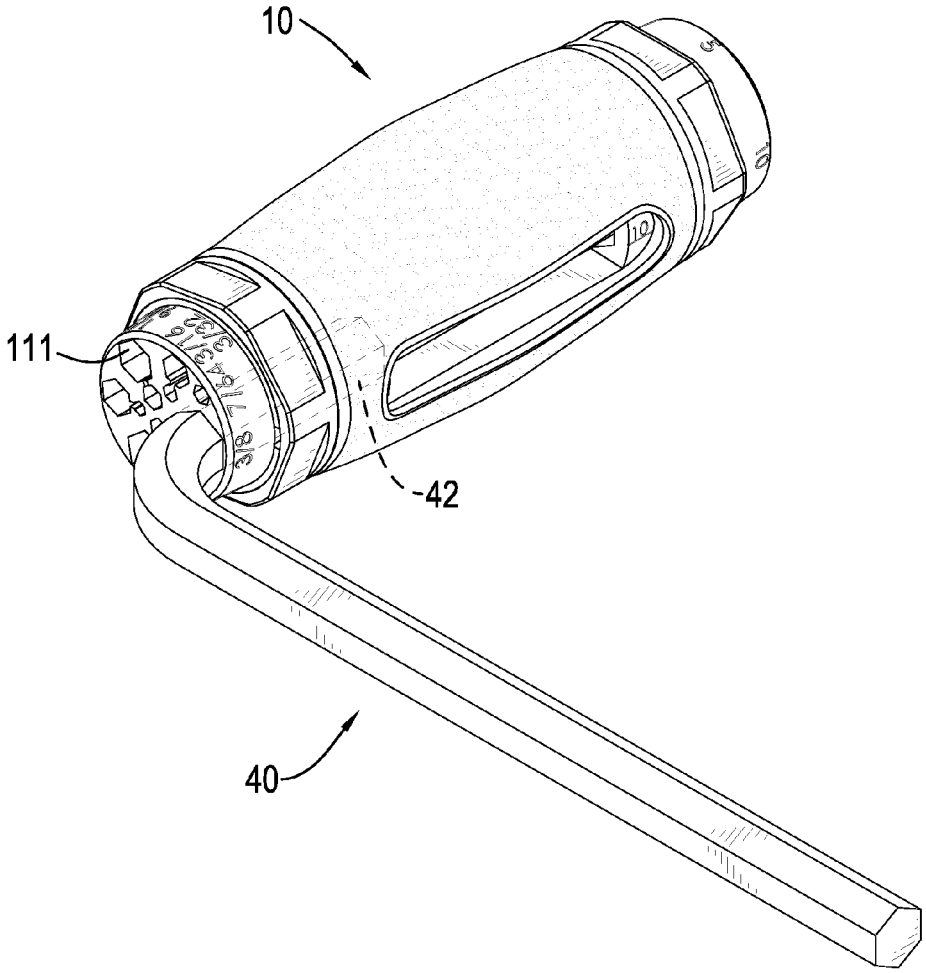
FIG. 9 is further another operational perspective view of the holder base of the combinational tool holder device in FIG. 1.

In use, one of the hexagon wrenches 40 is removed from the first combination holder 20 or the second combination holder 30. Then, the hexagon wrench 40 is inserted in a size-fitted one of the longitudinal insertion holes 111 or a size-fitted one of the radial insertion troughs 112 of the inner tube 11. With reference to FIGS. 1 and 7, a first segment 41 of the hexagon wrench 40 is inserted in a size-fitted one of the longitudinal insertion holes 111 and through the holder base 10. Alternatively, with reference to FIGS. 1 and 8, the outer tube 12 is rotated relative to the inner tube 11, such that the alignment hole 121 can be aligned with a size-fitted one of the radial insertion troughs 112. Then, a second segment 42 of the hexagon wrench 40 that is size-fitted with said radial insertion trough 112 can be inserted in said radial insertion trough 112 and then is inserted in the size-fitted longitudinal insertion hole 111 that communicates with said radial insertion trough 112. Alternatively, with reference to FIGS. 1 and 9, the second segment 42 of the hexagon wrench 40 is inserted in a size-fitted one of the longitudinal insertion holes 111. Therefore, the hexagon wrench 40 can be mounted on the holder base 10 to form different operating states and to further meet different using needs.

Figure 10:
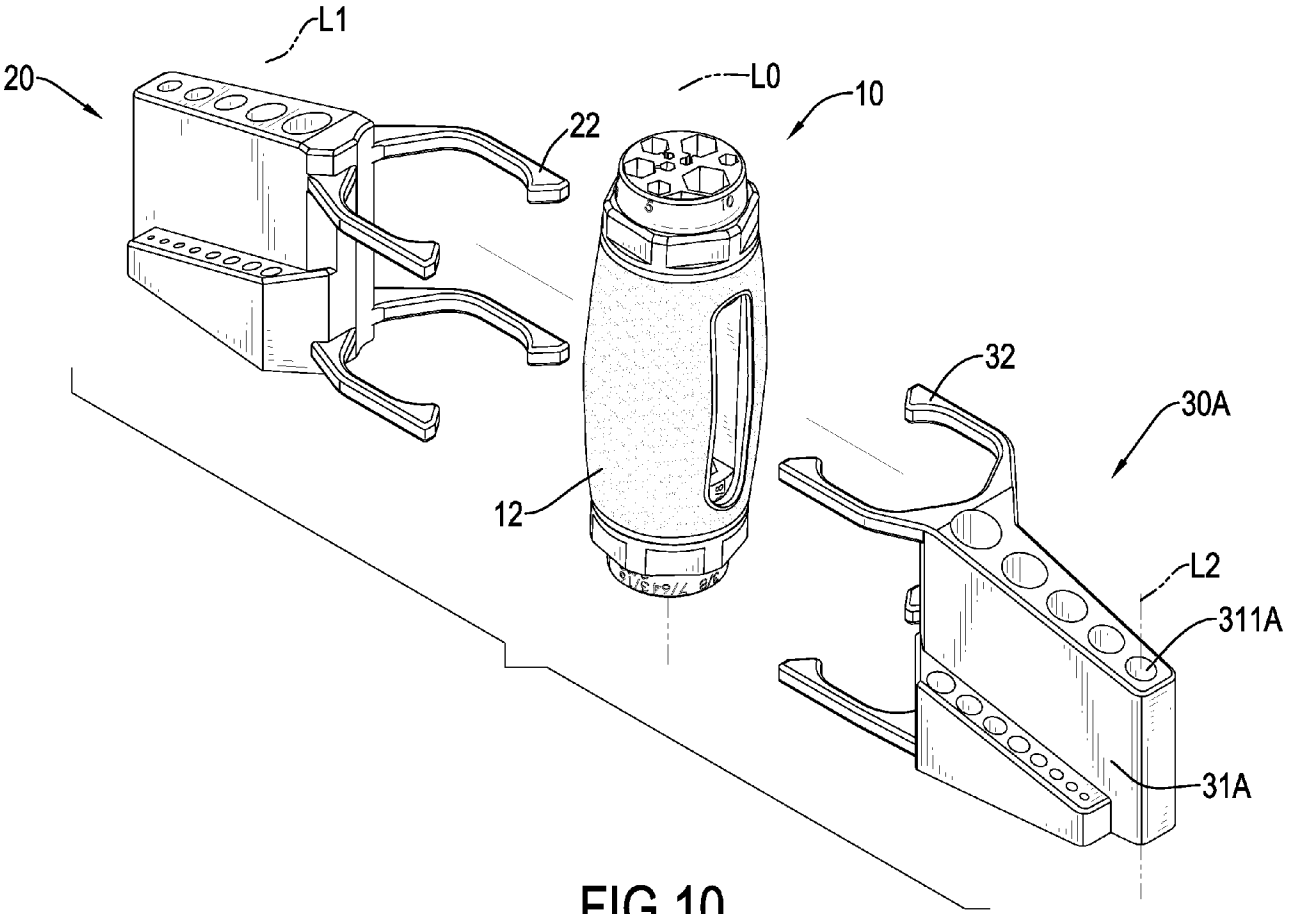
FIG. 10 is a perspective view of a second preferred embodiment of a combinational tool holder device in accordance with the present invention.

With reference to FIG. 10, a second preferred embodiment of a combinational tool holder device in accordance with the present invention has a second combination holder 30A that is different from the second combination holder 30 of the first preferred embodiment. The second combination holder 30A is detachably mounted around the holder base 10 and has a second holder body 31A and two second holder claws 32A. The second holder body 31A has thirteen tool insertion holes 311A. The tool insertion holes 311A of the second holder body 31A are hexagonal in cross section and are formed through the second holder body 31A at intervals. A longitudinal direction L2 of each tool insertion hole 311A of the second holder body 31A is parallel with the longitudinal direction L0 of the inner tube 11. The second holder claws 32A are C-shaped and radially elastic, are connected with the second holder body 31A, and are detachably mounted around the holder base 10. A first interval between the two second holder claws 32A is larger than the second interval between the two first holder claws 22.

From the above description, it is noted that the present invention has the following advantages:

1. The first combination holder 20 and the second combination holder 30 are detachably mounted around the holder base 10. Therefore, the hexagon wrenches 40 can be respectively inserted in the size-fitted tool insertion holes 211, 311 for portability.

2. The longitudinal insertion holes 111 and the radial insertion troughs 112 can be inserted by the size-fitted hexagon wrench 40 to meet different usage needs. The outer tube 12 can be rotated relative to the inner tube 11, such that the alignment hole 121 can be aligned with different radial insertion troughs 112. The outer tube fixing portion 113 and the engaging portions 122 can further position the outer tube 12 relative to the inner tube 11. One end of the outer tube 12 is engaged with the fixing ring 13, and the other end of the outer tube 12 abuts the abutting rib 115, such that the outer tube 12 can be held in position relative to the inner tube 11.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A combinational tool holder device having:

a holder base having an inner tube having multiple longitudinal insertion holes being hexagonal in cross section, longitudinally formed in the inner tube at intervals, and selectively formed through the inner tube; and multiple radial insertion troughs radially formed in the inner tube at intervals and respectively communicating with the longitudinal insertion holes;

a first combination holder detachably mounted around the holder base and having a first holder body having multiple tool insertion holes that are hexagonal in cross section and formed through the first holder body at intervals, wherein each tool insertion hole of the first holder body has a longitudinal direction that is parallel with a longitudinal direction of the inner tube; and two first holder claws being radially elastic, connected with the first holder body, and detachably mounted around the holder base;

a second combination holder detachably mounted around the holder base and having a second holder body having multiple tool insertion holes that are hexagonal in cross section and formed through the second holder body at intervals, wherein each tool insertion hole of the second holder body has a longitudinal direction that is parallel with the longitudinal direction of the inner tube; and two second holder claws being radially elastic, connected with the second holder body, and detachably mounted around the holder base, wherein a first interval between the two second holder claws is larger than a second interval between the two first holder claws.

2. The combinational tool holder device as claimed in claim 1, wherein the inner tube further has an outer tube fixing portion formed from the inner tube; and the holder base further has an outer tube that is hollow and rotatably mounted around the inner tube, and the outer tube has an alignment hole formed through the outer tube and selectively aligned with one of the radial insertion troughs; and multiple engaging portions formed from an interior surface of the outer tube at intervals, wherein one of the engaging portions is engaged with the outer tube fixing portion to form a concave-convex engagement.

3. The combinational tool holder device as claimed in claim 2, wherein the inner tube further has two fixing ring fixing portions formed from the inner tube opposite to each other and being adjacent to an end of the inner tube; and an abutting rib annularly protruding from the inner tube and being adjacent to another end of the inner tube opposite to the fixing ring fixing portion; and the holder base abuts the abutting rib and further has a fixing ring that is mounted around the inner tube opposite to the abutting rib and has two engaging points that are formed from an interior of the fixing ring opposite to each other and are respectively engaged with the fixing ring fixing portions.

4. The combinational tool holder device as claimed in claim 3, wherein the outer tube fixing portion protrudes from the inner tube, and the engaging portions are recessed from the interior of the outer tube at intervals.

5. The combinational tool holder device as claimed in claim 4, wherein the fixing ring fixing portions are L-shaped and are recessed from the inner tube, and the engaging points protrude from the interior of the fixing ring.

6. The combinational tool holder device as claimed in claim 1, wherein a number of the tool insertion holes of the first holder body is thirteen, and a number of the tool insertion holes of the second holder body is nine.

7. The combinational tool holder device as claimed in claim 2, wherein a number of the tool insertion holes of the first holder body is thirteen, and a number of the tool insertion holes of the second holder body is nine.

8. The combinational tool holder device as claimed in claim 3, wherein a number of the tool insertion holes of the first holder body is thirteen, and a number of the tool insertion holes of the second holder body is nine.

9. The combinational tool holder device as claimed in claim 4, wherein a number of the tool insertion holes of the first holder body is thirteen, and a number of the tool insertion holes of the second holder body is nine.

10. The combinational tool holder device as claimed in claim 5, wherein a number of the tool insertion holes of the first holder body is thirteen, and a number of the tool insertion holes of the second holder body is nine.

11. The combinational tool holder device as claimed in claim 1, wherein a number of the tool insertion holes of the first holder body is thirteen, and a number of the tool insertion holes of the second holder body is thirteen.

12. The combinational tool holder device as claimed in claim 2, wherein a number of the tool insertion holes of the first holder body is thirteen, and a number of the tool insertion holes of the second holder body is thirteen.

13. The combinational tool holder device as claimed in claim 3, wherein a number of the tool insertion holes of the first holder body is thirteen, and a number of the tool insertion holes of the second holder body is thirteen.

14. The combinational tool holder device as claimed in claim 4, wherein a number of the tool insertion holes of the first holder body is thirteen, and a number of the tool insertion holes of the second holder body is thirteen.

15. The combinational tool holder device as claimed in claim 5, wherein a number of the tool insertion holes of the first holder body is thirteen, and a number of the tool insertion holes of the second holder body is thirteen.

* * * * *